US006283287B1

(12) United States Patent
Carl

(10) Patent No.: US 6,283,287 B1
(45) Date of Patent: Sep. 4, 2001

(54) CARRYING CASE FOR TRANSPORTING AND STORING TWO GUITARS

(76) Inventor: Joseph Carl, 24815 Como Rd., Sterling, IL (US) 61081

( * ) Notice: Subject to any disclaimer, the term of this patent is extended or adjusted under 35 U.S.C. 154(b) by 0 days.

(21) Appl. No.: 09/576,857

(22) Filed: May 22, 2000

(51) Int. Cl.[7] ..... A45C 11/00
(52) U.S. Cl. ..... 206/314; 190/102
(58) Field of Search ..... 206/314, 14; 190/102, 190/108, 109

(56) References Cited

U.S. PATENT DOCUMENTS

| | | | |
|---|---|---|---|
| 270,640 | | 1/1883 | Cundy . |
| 343,073 | | 6/1886 | Seefels . |
| 1,274,003 | | 7/1918 | Christie . |
| 1,502,987 | | 7/1924 | Glass et al. . |
| 1,541,895 | | 6/1925 | Blair . |
| 1,650,672 | | 11/1927 | Walinsky . |
| 3,155,231 | | 11/1964 | Vinas . |
| 3,741,377 | | 6/1973 | Krellen . |
| 3,901,384 | * | 8/1975 | Lee et al. ..... 206/314 |
| 4,243,140 | | 1/1981 | Thrun . |
| 4,378,881 | | 4/1983 | de Vries . |
| 4,433,781 | | 2/1984 | Hummel . |
| 4,531,632 | | 7/1985 | Weber . |
| 4,659,000 | | 4/1987 | Sales et al. . |
| 4,693,344 | | 9/1987 | Shuler . |
| 4,795,030 | | 1/1989 | Boyce . |
| 5,219,075 | * | 6/1993 | White ..... 206/314 |
| 5,361,603 | | 11/1994 | Merritt-Munson . |
| 5,441,134 | | 8/1995 | Carson . |
| 5,442,986 | | 8/1995 | Cota . |
| 5,590,771 | | 1/1997 | Cota . |
| 5,833,051 | * | 11/1998 | Tiefenbrun et al. ..... 206/14 |
| 5,842,574 | | 12/1998 | Nunes . |
| 5,881,874 | | 3/1999 | McKinney . |
| 6,000,509 | | 12/1999 | Chisholm . |

* cited by examiner

*Primary Examiner*—Bryon P. Gehman
(74) *Attorney, Agent, or Firm*—Dykema Gossett PLLC

(57) ABSTRACT

A carrying case for transporting and storing two guitars, having two recesses adapted to hold both guitars firmly in place, and a hinged partition between the recesses supporting L-shaped body pads that urge each guitar into its respective recess when the case is closed.

17 Claims, 6 Drawing Sheets

CARRYING CASE FOR TRANSPORTING AND STORING TWO GUITARS

CROSS-REFERENCE TO RELATED APPLICATIONS

NOT APPLICABLE

STATEMENT REGARDING FEDERALLY SPONSORED RESEARCH OR DEVELOPMENT

NOT APPLICABLE

BACKGROUND OF THE INVENTION

1. Field of the Invention

The invention relates to a carrying case for transportation of guitars, and more particularly to a guitar case specifically designed to accommodate two electric guitars at the same time.

2. Background Information

The physics of sound production in musical instruments are such that extremely small variations in the physical structure of an instrument can produce detectable differences in the quality of the sound produced, and in the tactile responses apparent to the musician playing the instrument. Consequently, instruments tend to be considered highly personal, and musicians generally bring their instruments with them when they travel to remote venues to perform. In the case of some concert performers, this is true even of large and difficult to transport instruments such as grand pianos. More often, smaller instruments, such as guitars, are often moved by their owners from place to place. Guitars are relatively compact and light weight, and the ready transportability of the instrument is one of the chief attractions that the guitar has offered to guitarists throughout the history of the instrument. Despite the factors favoring guitar transportability, it is nonetheless true that guitars are fairly fragile. It is therefore preferable that they be protected by an enclosing case during transportation. A variety of cases have been developed to provide such protection. These cases are configured to transport a single guitar, and to include a small compartment for the transport of extra strings, picks, pitch-pipes, harmonicas, etc. Some performers, however, prefer to play more than one guitar during the course of a performance. This may be because alternative instruments are tuned to different keys, because the instruments are of different types, such as six-string and twelve string varieties, or simply because the aforementioned variation between instruments simply makes one preferred by the artist over another for the performance of a particular song. The availability of a second instrument also allows the performer to rapidly switch from one instrument to another as in the case of string breakage during a performance. In any case, the transportation of more than one guitar, each in its individual case, can be awkward and otherwise inconvenient.

BRIEF SUMMARY OF THE INVENTION

The present invention addresses the above-described circumstances by providing a single integral guitar case adapted to the convenient simultaneous transportation of two electric guitars, along with the appropriate ancillary materials. The case, as disclosed herewithin, provides a first padded compartment for securely holding a first guitar and a second padded compartment for securely holding a second guitar, along with a hinged padded partition separating the first guitar from the second guitar when the case is in its closed position. In addition, the case may also include at least one internal compartment adapted to the transportation of ancillary materials such as guitar strings, picks, pitch-pipes, and the like.

Accordingly, the following drawings are provided, in which like parts bear like numerals throughout the several views. Without limiting the invention, the drawings further disclose its features, particularly when viewed in conjunction with the following detailed description of the invention.

DETAILED DESCRIPTION OF THE INVENTION

Figure 1:
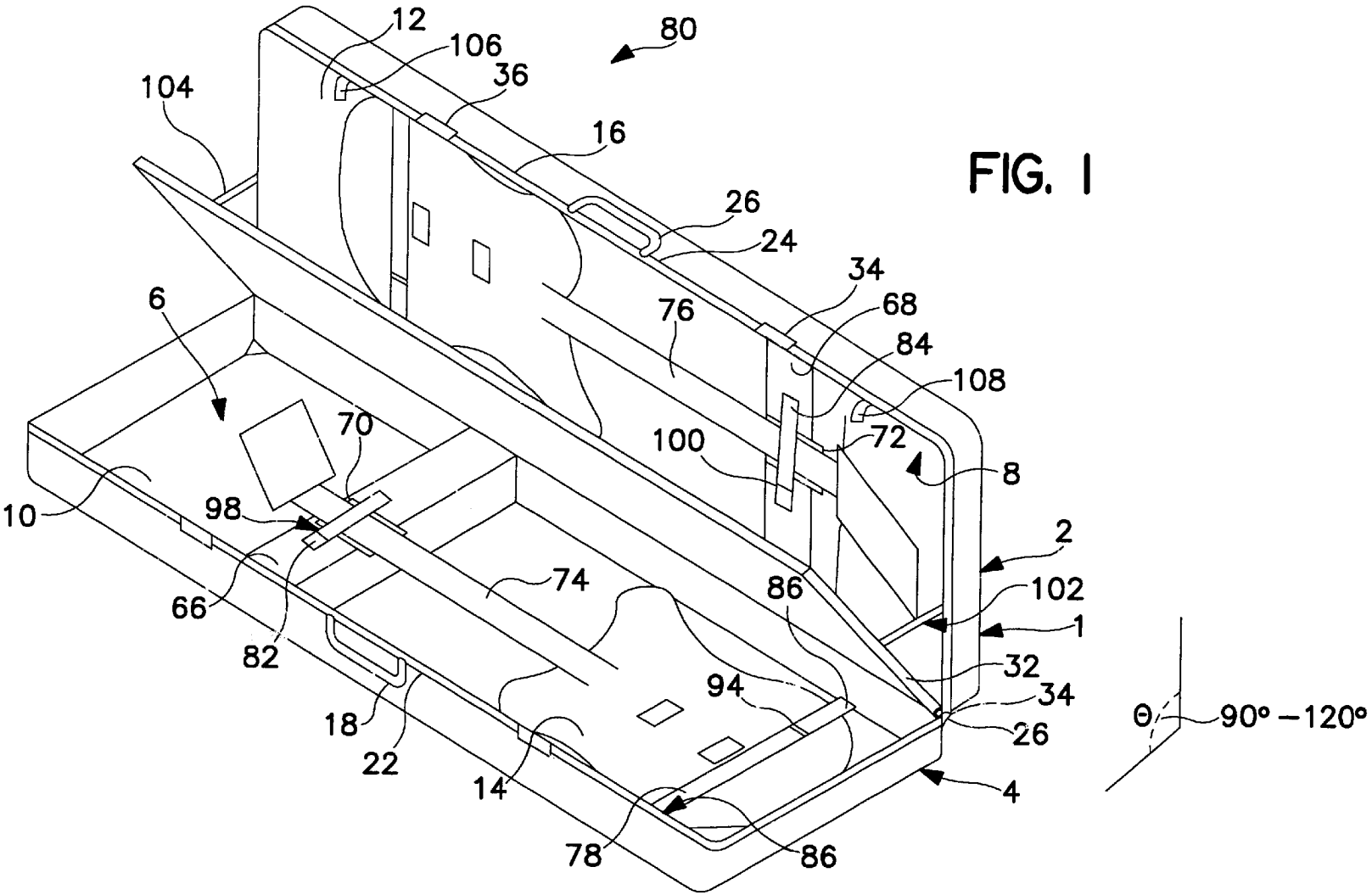
FIG. 1 shows a schematic perspective view of the guitar case of the invention disclosing the arrangement of the two guitars within the case when the case is in its open position.
Figure 2B:
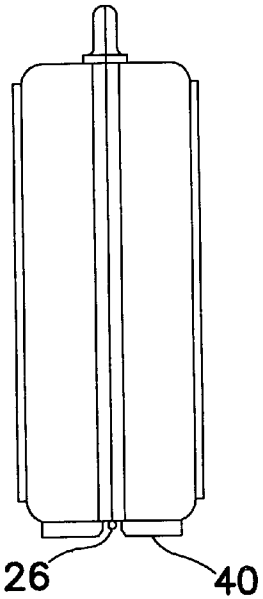
FIG. 2B shows a schematic end view of the exterior of the guitar case in a closed state.

Referring to the figures, FIG. 1 illustrates a carrying case 1 for transporting and storing two guitars. The case includes first 2 and second 4 elongate convex shells. Each convex shell has an internal surface 6, 8 defining a recess 10,12 adapted to contain an electric guitar 14,16 or other similar musical instrument. In the embodiment presented, the shells 2,4 are generally rectangular in shape. They are formed of molded polymer resin and provide a hard and durable enclosure for two guitars 14,16. Two handles l8,20 are provided, one attached to an upper peripheral edge 22,24 of each shell. These handles are conventionally hinged and aligned in such a fashion that they may be readily simultaneously grasped when the case is closed in order to lift the case. The handles are positioned so that when the guitars are positioned with their respective bodies at opposite ends of the case, the closed case will balance about the handles. Each shell is fastened to a common hinge 26 along an edge of the shell 28,30 opposite that bearing the handle. The hinge 26 allows the two shells to operate swingingly between an open position, as shown in FIG. 1, and a closed position, as shown in FIG. 2B. In the closed position as shown in FIG. 2B both guitars are entirely enclosed within the case. In the open position as shown in FIG. 1 the two shells lie in intersecting planes intersecting at an angle of between about 90 degrees and about 120 degrees. In the open position both guitars may be accessible depending on the position of a partition 32 disposed to between the two shells. Latches

Figure 2A:
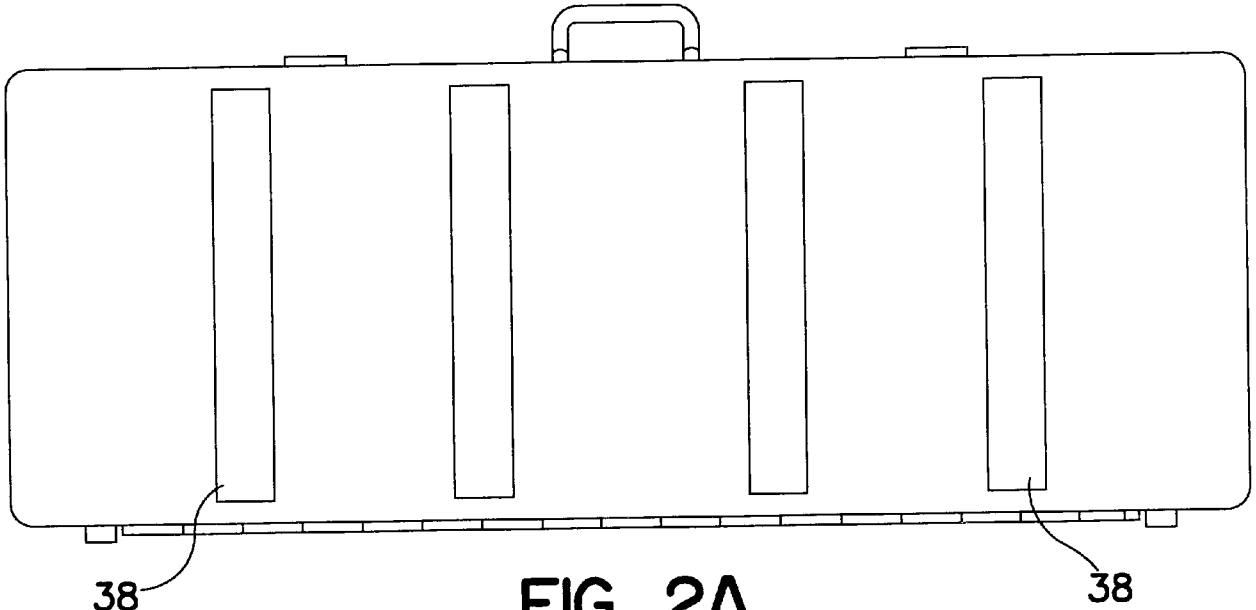
FIG. 2A shows a schematic top view of the exterior of the guitar case in a closed state.
Figure 2C:
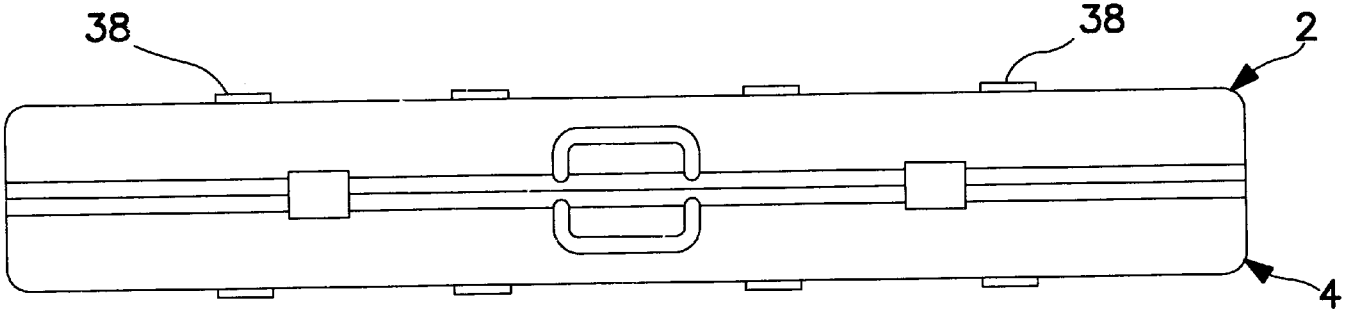
FIG. 2C shows a schematic side view of the exterior of the guitar case in a closed state.

34,36 are provided along the same edge of each shell as that bearing the handle. These latches serve to maintain the case in a closed position during transportation or storage. The latches may be lockable, thereby protecting the contents of the case from casual inspection or removal. In the embodiment shown, the case is provided with elevations or ridges 38, as shown in FIG. 2, molded into the surface of the polymer shell. These ridges serve to increase the structural strength of the shell wall, and to limit the portion of that surface of the wall scuffed and scraped when the case is moved against an abrasive surface. Also molded on the surface of each shell are projections which serve as feet 40 when the guitar case is in the closed and upright position. These feet serve to preserve and protect the hinge 26 to and to increase the stability of the guitar case when in the closed and upright position as shown in FIG. 2B.

As noted above, FIG. 1 illustrates the case in its open configuration. In this view a hinged partition 32 positioned therewithin is visible. The partition is substantially rigid and hingedly supported by an internal surface 42 of one shell with a hinge 44 as illustrated in FIG. 3.

Figure 4:
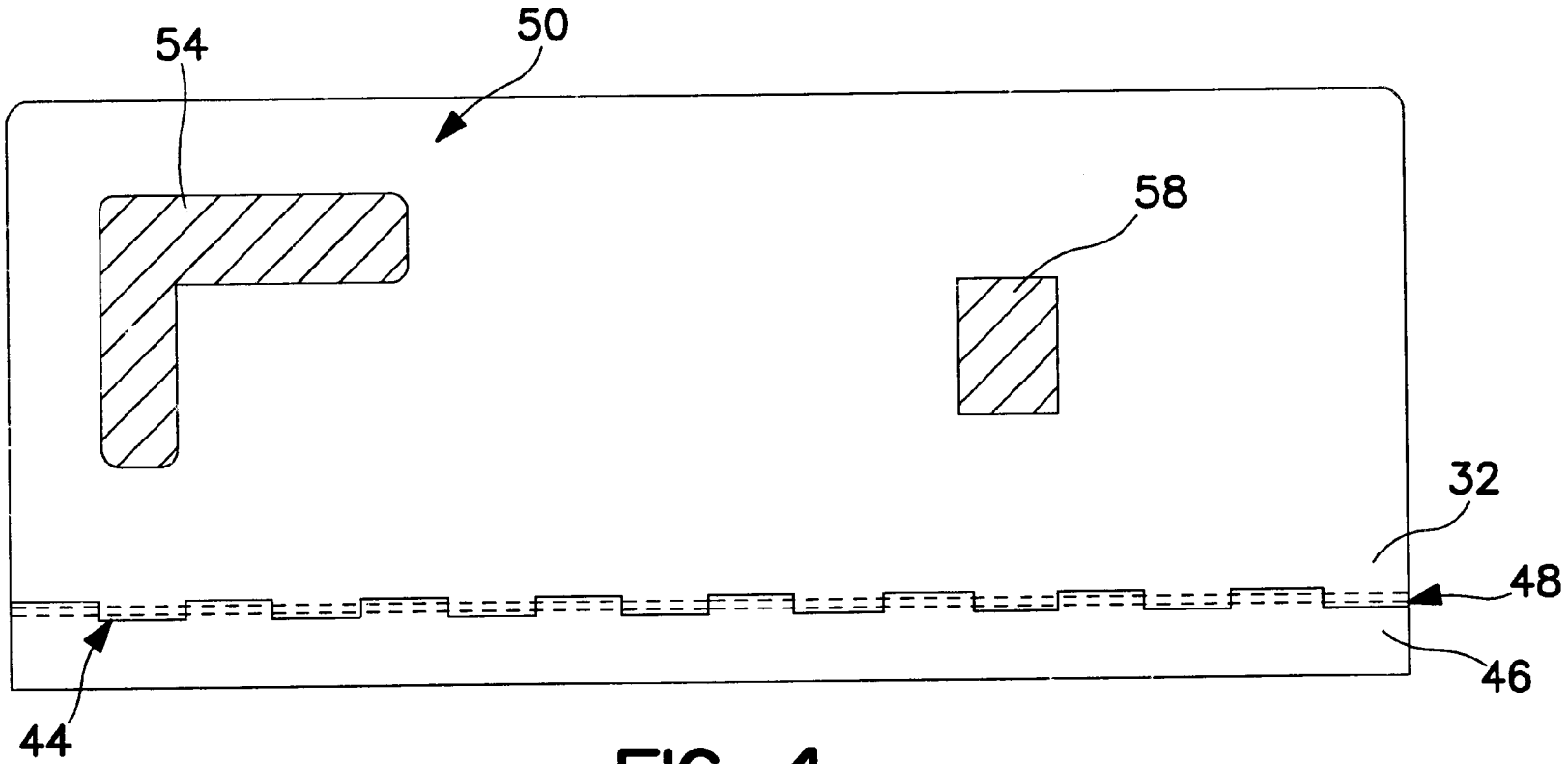
FIG. 4 shows a schematic top view of the partition, including the arrangement of the hinge and placement of compressively elastic pads.

As further illustrated in FIG. 4, the hinge 44 includes interlocking portions of the partition 32 and a support portion 46 joined by a hinge pin 48. In one embodiment, the support portion is integrally molded with the shell which supports it. In another embodiment, the support portion is fastened to the shell after molding is complete.

Figure 3:
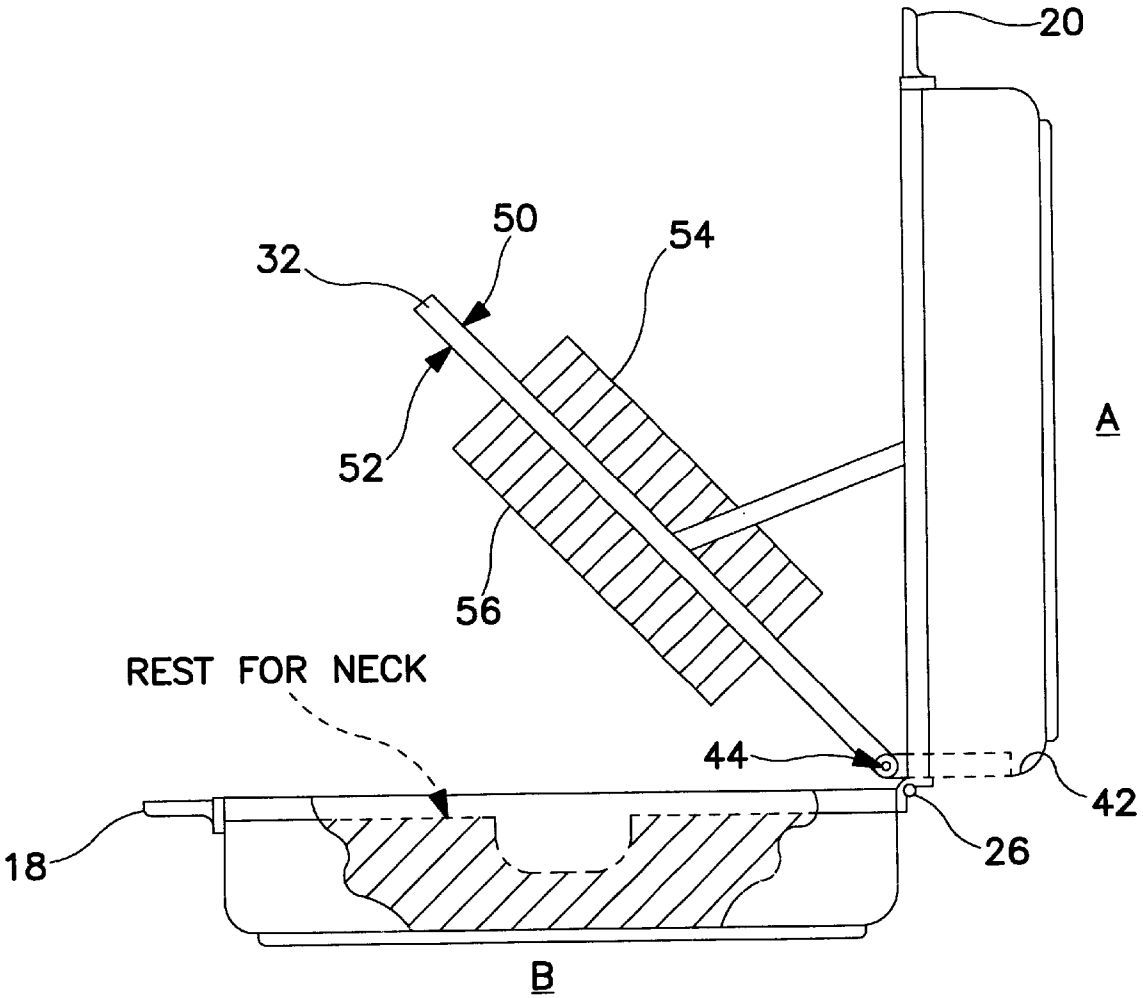
FIG. 3 shows a schematic end view of the guitar case in an open closed state with the partition deployed.
Figure 6:
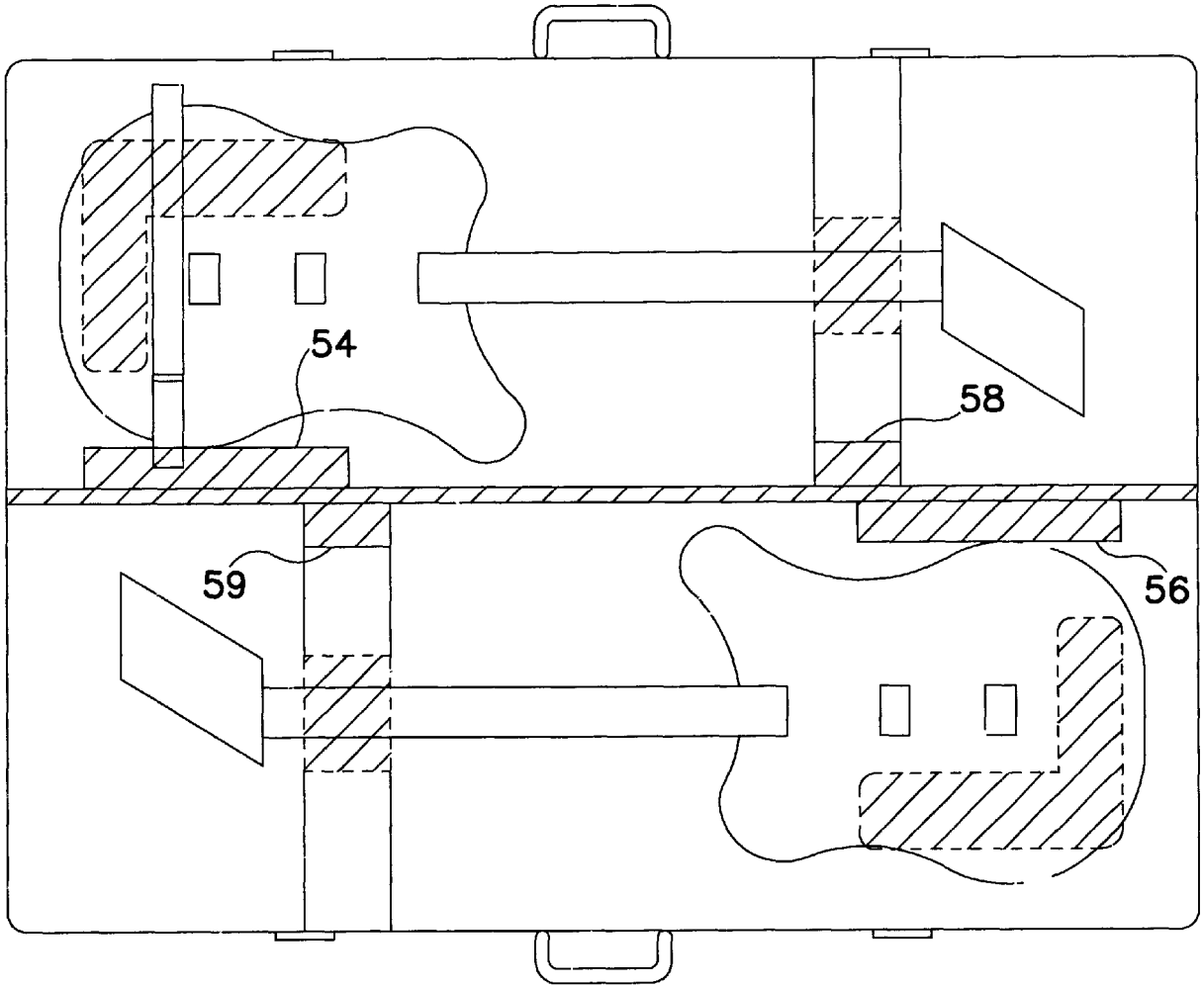
FIG. 6 shows a broken out view of the guitar case showing the relative position of two guitars within their respective recesses, including indications of the areas contacted by body and neck pads.

As shown in FIG. 3, first and second surfaces 50,52 of the partition 32 support compressively elastic body pads 54,56. Similarly, surfaces 50 and 52 support compressively elastic neck pads as exemplified by the neck pad 58 shown in FIG. 4, and further shown 58,59 in FIG 6.

Figure 5:
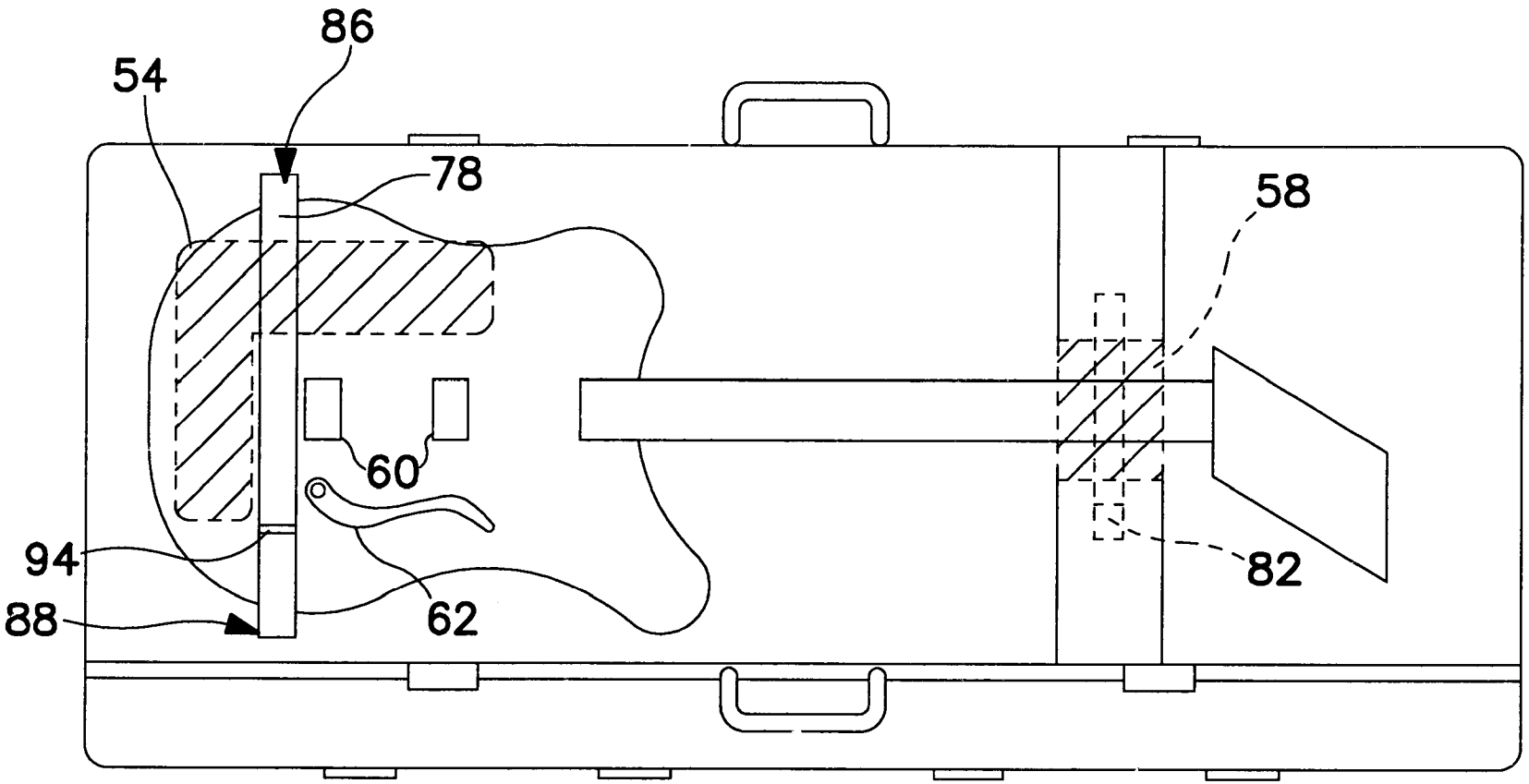
FIG. 5 shows a schematic side view of the guitar case in an open state with the partition retracted and illustrating the position of one guitar therewithin

As further illustrated in FIG. 5, the body pads 54,56 are configured in an L-shape so as to avoid contact with the pickups 60, or vibrato arm 62, of a guitar placed within the case. This is advantageous since storage of a guitar with its vibrato arm compressed can result in stretching of the strings, with consequent de-tuning of the instrument and possible shortening of string life.

As shown in FIG. 1, each shell also includes a neck rest 66,68 fixedly supported by the inner surface 6, 8 of the respective shell. Each neck rest includes a bearing surface 70, 72 configured to support and locate the neck 74,76 of a guitar.

FIG. 1 also illustrates a body strap 78, 80 and neck strap 82, 84 included in one embodiment. These straps serve to secure the guitar in place within its respective shell, and particularly to hold the supper guitar in place prior to retraction of the partition 32 into its upright position, at which time the body and neck pads mounted theron urge the guitar 16 gently and firmly into the recess 8 of the upper shell 2.

In the embodiment shown, as exemplified in FIG. 5 each body strap is secured at its two ends 86, 88 to the inner surface of its respective shell. As illustrated, a hook and loop fastener 94 is positioned at an intermediate point on the body strap. This fastener allows easy fastening of the strap in position across the body of the guitar.

A similar hook and loop fastener 98, 100 is provided on the neck strap 82, 84. In one embodiment, a ribbon 102, 104, as shown in FIG. 1, is provided to support the partition in a deployed position intermediate the two shells. In an alternative embodiment this ribbon is replaced with a limited hinge mechanism.

In a further embodiment a hook and loop fastener 106, 108 is provided to maintain the partition 32 in a retracted position.

In yet further embodiments, the shell recesses are equipped with one or more additional compartments adapted to hold spare strings, picks, and ancillary materials. Also, the inner surfaces of the case are lined with non-abrasive material such as felt or fake fur.

The foregoing disclosure will suggest to those of ordinary skill in the art many obvious improvements and variations of the disclosed invention, all of which are considered to be within the scope of the invention.

I claim:

1. A carrying case for transporting and storing two guitars comprising, first and second elongate convex shells having first and second internal surfaces and first and second peripheral edges respectively, said shells hingedly connected to one another at corresponding portions of said peripheral edges, said internal surfaces defining recesses adapted to hold first and second electric guitars respectively, said shells operable for movement between a closed position and an open position whereby in said closed position said the guitars are oriented substantially parallel facing each other, and in said open position said guitars lie in intersecting planes, a partition having first and second opposite faces and a joining edge, said partition hingedly supported at said joining edge by said internal surface of said first shell, said partition operable when said shells are in said open position for movement between a deployed position and a retracted position whereby when said partition is retracted, said recess of said first shell is substantially enclosed by said first internal surface and said first face and when said partition is deployed, said recess of said first shell is accessible for insertion and removal of said first guitar, and first and second compressively elastic body pads supported on said first and second faces respectively, said body pads positioned and adapted to urge the respective guitars into said respective recesses, when said shells are in said closed position.

2. A case for two guitars as defined in claim 1, wherein said body pads are L-shaped and are positioned and adapted to urge the respective guitars into said respective recesses when said shells are in said closed position without contacting a pickup or vibrato arm of a respective guitar.

3. A case for two guitars as defined in claim 1, further comprising a ribbon connecting said partition and said first shell whereby when said shells are in said open position the deployed position of said partition is limited to a position intermediate said first and second shells.

4. A case for two guitars as defined in claim 1, wherein said intersecting planes intersect at an angle in the range from about 90 degrees to about 110 degrees.

5. A case for two guitars as defined in claim 1, wherein said intersecting planes intersect at an angle in the range from about 90 degrees to about 120 degrees.

6. A case for two guitars as defined in claim 1, further comprising an elongate body strap within said recess of said first shell, said body strap having two ends fixedly attached to said internal surface defining said recess, said body strap adapted to secure one guitar within said recess of said first shell.

7. A case for two guitars as defined in claim 1, further comprising first and second flexible elongate body straps within said first and second recesses respectively, said body straps each having two ends fixedly attached to said internal surface defining said respective recess, said body straps adapted to secure a respective guitar within their respective recess during transportation and storage.

8. A case for two guitars as defined in claim 7, wherein each said body strap is separable at an intermediate point along its length to form two body sub-straps each having an internal end, said internal ends each supporting a fastener to fasten said internal ends of each said respective body strap to one another.

9. A case for two guitars as defined in claim 8, wherein said fasteners each comprise a hook and loop fastener.

10. A case for two guitars as defined in claim 1, wherein said first and second shells each comprise molded polymer resin.

11. A case for two guitars as defined in claim 1, wherein said first and second shells include ridges adapted to strengthen said shells.

12. A case for two guitars as defined in claim 1, further comprising first and second neck rests supported by said first and second internal surfaces respectively, said neck rests each adapted to support a neck of a respective guitar, and first and second compressively elastic neck pads supported by said first and second faces respectively, said neck pads positioned and adapted to urge the respective guitar neck against said respective neck rest.

13. A case for two guitars as defined in claim 1, further comprising first and second flexible elongate neck straps within said first and second recesses respectively, said neck straps each having two ends fixedly supported by said internal surface defining said respective recess, said neck straps adapted to secure a respective guitar within said respective recess during transportation and storage.

14. A case for two guitars as defined in claim 13, wherein each said neck strap is separable at an intermediate point along its length to form two neck sub-straps each having an internal end, said internal ends each supporting a fastener to fasten said internal ends of each said respective neck strap to one another.

15. A case for two guitars as defined in claim 1 wherein said pads and straps are positioned for insertion of a first guitar with its body oriented proximate a first end of said case and insertion of a second guitar with its body oriented proximate an opposite second end of said case whereby said case, when containing two guitars and closed, is substantially balanced about a point intermediate said first and second ends.

16. A case for two guitars as defined in claim 1 wherein said pads are comprised of closed cell neoprene.

17. A method of transporting two electric guitars in a single case comprising, providing a single case having first and second recesses and a partition having first and second faces hingedly mounted therebetween, supporting first and second compressively elastic L-shaped pads on said first and second faces respectively, supporting first and second compressively elastic neck pads on said first and second faces respectively, opening said case, moving said partition to a deployed position, providing first and second body straps and first and second neck straps within said first and second recesses respectively, placing a first electric guitar within said first recess, fastening said first body strap across a body of said first guitar, fastening said first neck strap across a neck of said first guitar, moving said partition to a retracted position, compressing said first L-shaped pad against said body of said first guitar and thereby urging said first guitar inwardly of said first recess, closing said case, placing a second electric guitar within said second recess, fastening said second body strap across a body of said second guitar, fastening said second neck strap across a neck of said second guitar, closing said case, compressing said second L-shaped pad against said body of said second guitar and thereby urging said second guitar inwardly of said second recess.

* * * * *